United States Patent [19]

Frank

[11] 3,964,679

[45] June 22, 1976

[54] RAILROAD GUARD RAILS

[75] Inventor: Earl E. Frank, Tallman, N.Y.

[73] Assignee: Abex Corporation, New York, N.Y.

[22] Filed: May 6, 1974

[21] Appl. No.: 467,403

[52] U.S. Cl. ..... 238/17
[51] Int. Cl.[2] ..... E01B 5/18
[58] Field of Search ..... 238/17–23, 238/287; 104/242, 245

[56] References Cited

UNITED STATES PATENTS

| | | | |
|---|---|---|---|
| 821,897 | 5/1906 | Steward | 238/17 |
| 949,253 | 2/1910 | Alden | 238/17 |
| 1,636,302 | 7/1927 | Goodwin | 238/20 |
| 1,638,739 | 8/1927 | Maney | 238/20 |
| 2,024,110 | 12/1935 | O'Neill | 238/20 |
| 3,026,074 | 3/1962 | Kern | 238/17 |
| 3,581,989 | 6/1971 | Pohling | 238/21 |

*Primary Examiner*—M. H. Wood, Jr.
*Assistant Examiner*—Richard A. Bertsch
*Attorney, Agent, or Firm*—Kinzer, Plyer, Dorn & McEachran

[57] ABSTRACT

A guard rail assembly for supporting a guard rail adjacent to and higher than a traffic rail. Brace means are provided on the outer side of the guard rail away from the traffic rail. An upper portion of the brace means engages the outer face of the guard rail head, and a lower portion engages the web of the guard rail. A shim plate supports the base of the guard and has an inner upwardly extending lip in engagement with an inner face of the guard rail base. A tie plate underlies and supports the rails, brace means and shim plate.

6 Claims, 9 Drawing Figures

RAILROAD GUARD RAILS

BACKGROUND OF THE INVENTION

This invention relates in general to railroad track work, and more particularly to a guard rail assembly for supporting a guard rail with its tread surface above and adjacent the tread surface of the traffic rail.

Guard rails are conventionally used, at places such as switches, frogs and curves where there may be some possibility of derailments, to hold the wheel-flanges of railroad vehicles against the traffic rail. Heretofore, guard rail assemblies have been produced which support the guard rail either level with or above the traffic rail. It has been found that in a guard rail which is higher than the traffic rail, hereinafter referred to as a high guard rail, extreme lateral forces are developed. Prior attempts to support high guard rails have not been completely satisfactory because stressing of the guard rails under such conditions has not always been effectively eliminated. A common arrangement for supporting a high guard rail involves a support against the outer face of the guard rail web or underside of the guard rail head and means bearing against the top surface of the inner base-flange of the guard rail. Since the lateral forces induced by the wheel flanges of a railroad vehicle act against the inner face of the guard rail head, and no opposing force acts against the outer face of the guard rail head, the force creates a moment in the guard rail which tends to stress and displace it.

SUMMARY OF THE INVENTION

An object of the present invention is to reduce stress risers, and points of fatigue due to stressing or bending of the guard rail by providing an improved high guard rail assembly which laterally supports the outer face of the guard rail head and the inner face of the base of the guard rail. The high guard rail assembly of the present invention includes a plurality of tie plates arranged along a guard rail and capable of supporting the guard rail with a traffic rail in side by side relationship, such that the head of the guard rail is spaced above the head of the traffic rail. A brace is located on the outer side of the guard rail, away from the traffic rail, and includes an upper surface in engagement with the outer face of the guard rail head and a lower portion in engagement with the web of the guard rail. A shim plate supports the base of the guard rail and has an upwardly extending lip in engagement with the inner face of the guard rail base to prevent the inward lateral movement thereof.

It is therefore an object of the present invention to provide an improved high guard rail assembly for supporting a guard rail relative to a traffic rail such that the head of the guard rail is spaced above the head of the traffic rail.

Another object of this invention is to provide a high guard rail assembly including a brace against the outer face of a guard rail head to directly oppose the lateral forces acting against the inner face of the guard rail head.

Another object of the present invention is to provide a high guard rail assembly which resists the inward lateral movement of the guard rail base toward the traffic rail, thereby resisting the bending of the guard rail due to the movement of the force acting against the guard rail head.

Another object of the present invention is to provide a high guard rail assembly including an enlarged surface on the inner face of the guard rail head to provide as much guarding as possible on the flat face of the back of a railroad vehicle wheel.

Another object of the present invention is to rigidly secure a guard rail relative to a traffic rail, but independently thereof.

Other objects, features and advantages of the invention will be apparent from the following detailed disclosure, taken in conjunction with the accompanying sheets of drawings, wherein like reference numerals refer to like parts.

DESCRIPTION OF THE PREFERRED EMBODIMENTS

Figure 1:
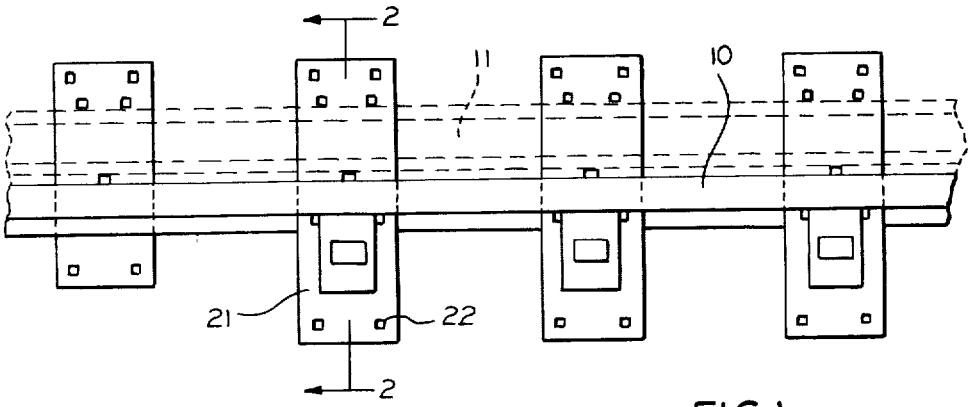
FIG. 1 is a fragmentary plan view of a guard rail support in accordance with the present invention.

FIG. 1 shows one embodiment of the invention concerned with properly supporting a guard rail 10 spaced laterally from a traffic rail 11.

Figure 2:
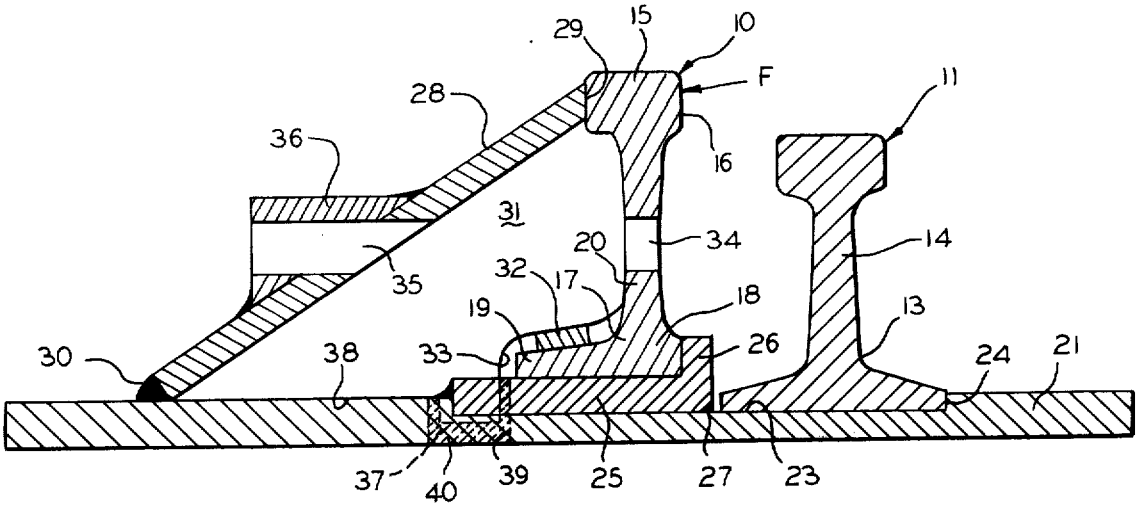
FIG. 2 is a section view on line 2—2 of FIG. 1, but showing the traffic rail in place.

As seen most clearly in FIG. 2, the traffic rail 11 includes a head 12, a base 13 and an interconnecting web 14. The guard rail 10 is a modified form of the conventional, well-known type and includes a head 15 having a guarding surface 16, a base 17 including an inner base flange 18 and an outer base flange 19, and an interconnecting web 20.

In FIG. 2, the guard rail 10 is positioned so that the head 15 is above the head 12 of the traffic rail 11 as hereinafter described.

Figure 3:
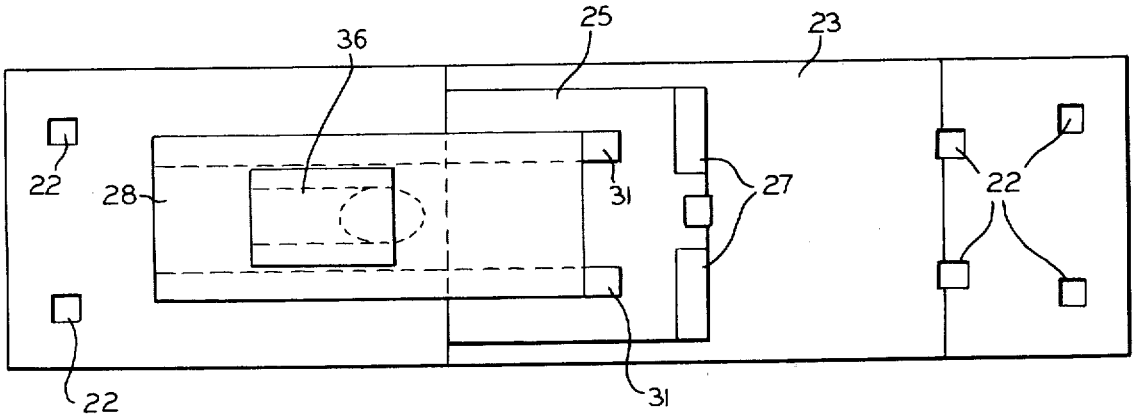
FIG. 3 is a top plan view of the structure in FIG. 2 but with the rails removed.
Figure 4:
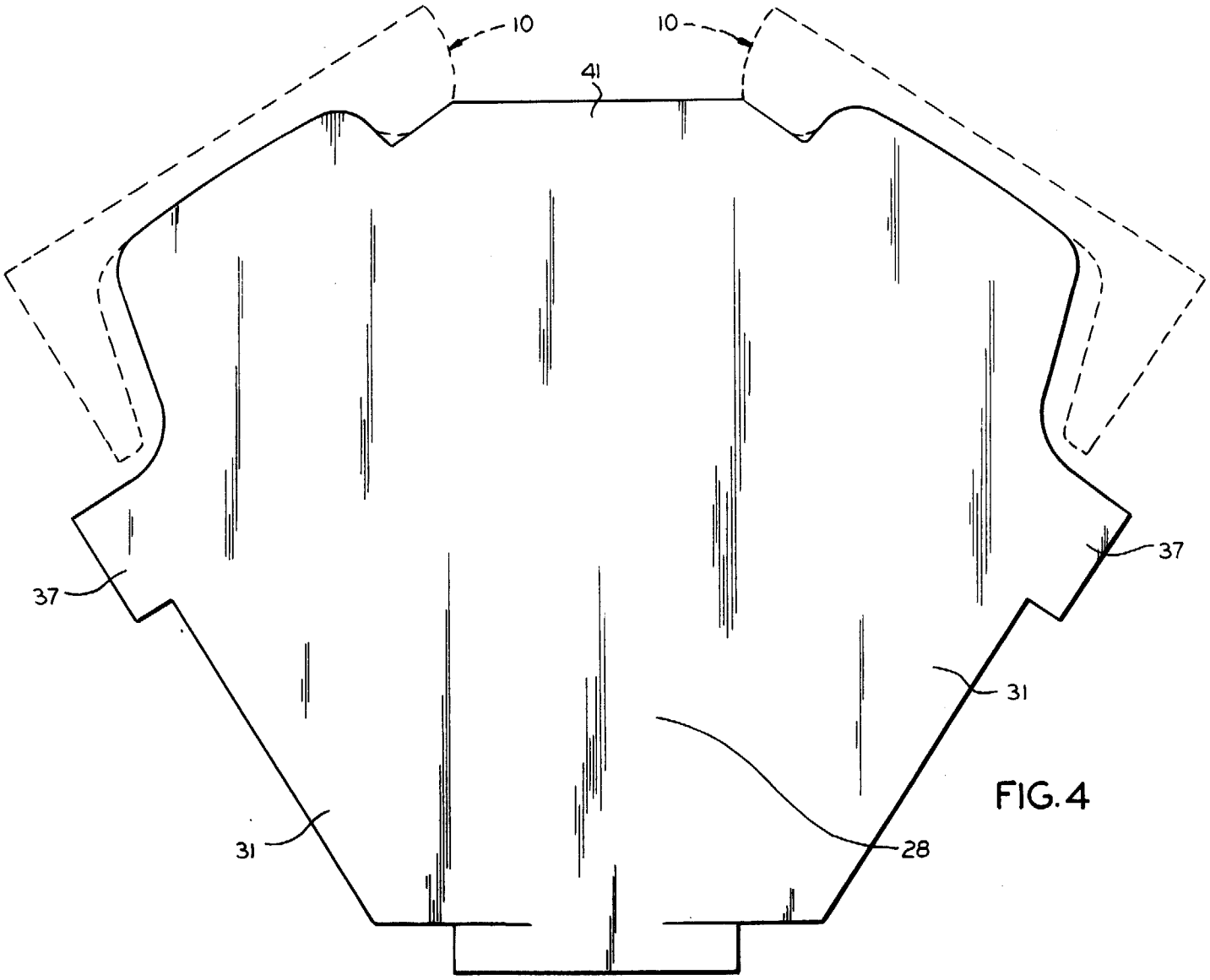
FIG. 4 is a projection of the guard rail brace of FIG. 3.
Figure 5:
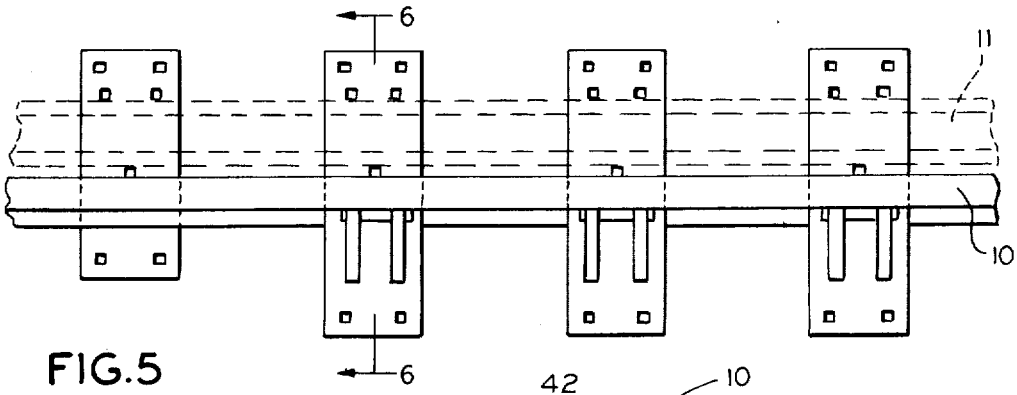
FIG. 5 is a plan view, similar to FIG. 1, of a modified form of the invention.
Figure 6:
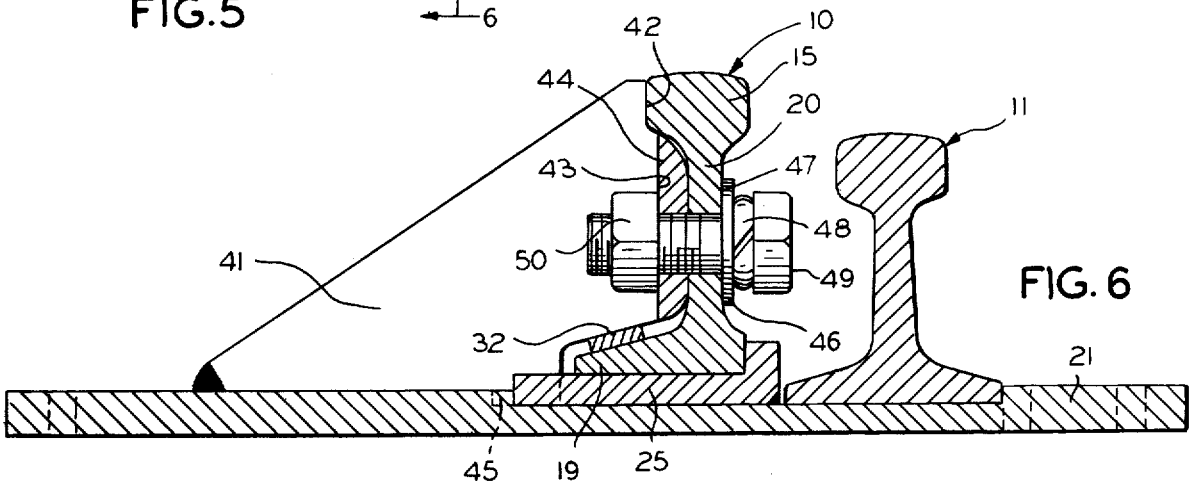
FIG. 6 is a section view on line 6—6 of FIG. 5 but showing the traffic rail in place.
Figure 7:
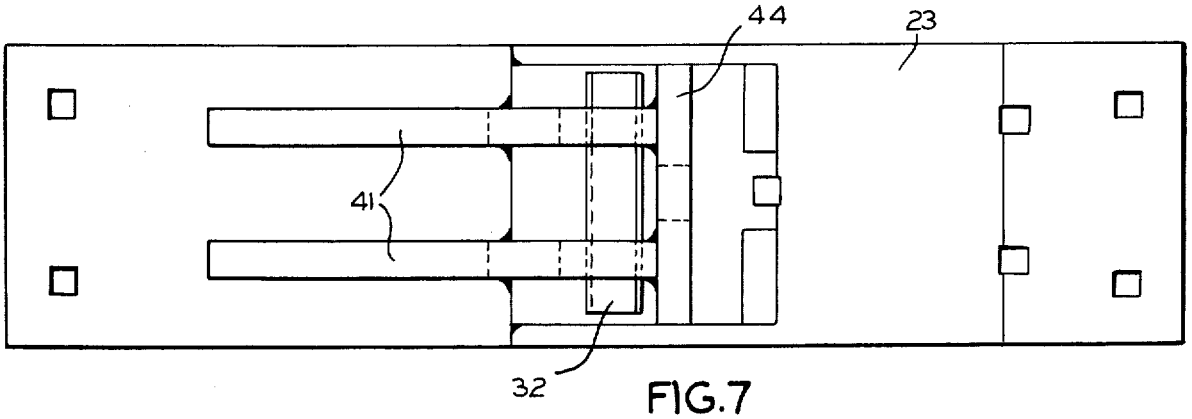
FIG. 7 is a top plan view of the structure in FIG. 6 but with the rails removed.
Figure 8:
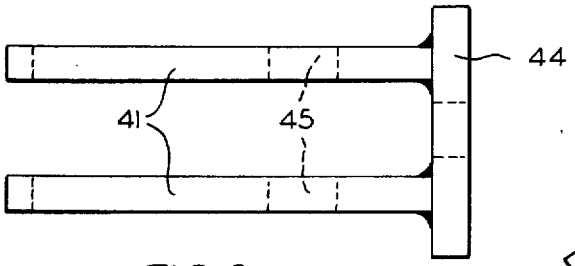
FIG. 8 is a top plan view of the brace means shown in FIG. 7.

To support the rails on a tie, a tie plate 21 is afforded as shown in FIGS. 2 and 3, the tie plate having openings 22 enabling the usual fastening spikes to be applied.

To properly position the rails, the tie plate has a slot 23 of sufficient dimension to accommodate the base 13 of the traffic rail 11 and certain parts for supporting the base 17 of the guard rail 10 as will be explained. The outer edge 24 of the traffic rail base 13 abuts a shoulder at one extremity of the tie plate slot 23.

To elevate the guard rail 10 with its head 15 above the traffic rail 11, a shim plate 25 having a lip 26 thereon for a purpose to be described is interposed between the bottom wall of the tie plate slot 23 and the underside of the base 17 of the guard rail 10.

To rigidly secure the shim plate 25 within the tie plate slot 23, fillet welds are applied between the shim plate 25 and tie plate 21 along the two sides perpendicular to the rails and partially along the outer edge of the shim plate. Furthermore, the bottom inner edge 27 of the shim plate may be chamfered and welded to the tie plate so as to form a flat inner surface of the lip and shim plate as best shown in FIG. 2.

In operation, the guarding surface 16 of the guard rail 10 may be required to resist extreme lateral thrust of a railroad vehicle wheel. To resist this thrust, both the head of the guard rail and the guard rail web are braced. In the embodiment shown in FIGS. 1 through 4, a flat inclined center brace 28 has an upper edge 29 engaged flush against the outer face of the guard rail head 15. The outer end of the center brace 28 is rigidly secured to the tie plate 21 outwardly from the guard rail 10 by a fillet weld 30. Underlying and supporting the side edges of the center brace 28 are two side braces 31. The inner surface of each side brace 31 engages the outer face of the guard rail web 20 to provide lateral support therefor. It is preferred that the side braces 31 and center brace 28 together continuously engage the outer face of the guard rail head, the underside of the guard rail head and the outer face of the guard rail web so as to maximize the supporting contact surface between these members.

To hold the guard rail down in seated position on the shim plate 25, a locking plate 32 is provided between the side braces and the upper face of the outer guard rail base-flange 19. The lower edge 33 of each of the side braces is spaced sufficiently from the upper surface of the guard rail base to facilitate placement of the guard rail during installation. Thereafter, the locking plate 32 is positioned between the bottom inner surface 33 of the side braces and the guard rail base and secured in place such as by welding the same to the side braces.

To secure the guard rail into rigid engagement with the braces 28 and 31, the guard rail web 20 and center brace 28 are provided with holes 34 and 35 respectively, through which a bolt may be inserted and securely fastened with a nut on one end. To provide a vertical bearing surface on the inclined center brace 28, against which the nut of a bolt may be tightened, a bolt housing 36 (FIGS. 2 and 3) is rigidly affixed to the center brace 28. The bolt housing 36 is aligned with the hole 35 and extends horizontally outwardly therefrom. The bolt housing 36 is preferably welded to the center brace 28 along the entire perimeter of the housing 36.

To resist the turning moment of the lateral forces applied against the inner face of the guard rail head, which tend to rotate the guard rail counter-clockwise as shown in FIG. 2, the inner lip or flange 26 of the shim plate 25 bears against the inner face of the guard rail base 17. As outward lateral force is applied to the guard rail head at 16, the guard rail tends to rotate about the brace means engaging the guard rail web 20, thereby inducing an inward lateral movement of the guard rail base 17. However, since the shim plate 25 is rigidly welded to the tie plate 21 and the integral shim plate lip 26 bears against the inner face of the guard rail base 17 as force is applied to the guard rail, any inward lateral movement of the guard rail base 17 is effectively eliminated.

Further to resist the turning moment or lateral thrust, the inner guard rail base-flange 18, that is the flange on the side of the traffic rail, is machined off or otherwise shortened complementally to engage the moment resisting lip 26 of the shim plate 25.

To secure the traffic rail base 13 to the tie plate 21 on the side facing the guard rail, an opening for a railroad spike is generally centrally located on tie plate 21, as best shown in FIG. 3. A center portion of the shim plate lip 26 is cut away to provide space for head of the traffic rail spike and a slot extends through the shim plate to expose the tie plate opening for the spike.

Further to anchor each side brace 31 against outward lateral movement, a lug 37 is formed and extends downwardly from the bottom edge 38 of each side brace. The lug is freely received within a generally rectangular opening 39 in the tie plate 21, the opening 39 being slightly larger than the lug so that the lug will initially move freely into the opening 39. Thereafter, a plug weld 40 is provided to rigidly interconnect the side brace 31 and the tie plate 21. The plug weld is formed to completely close the opening 39 in which the lug is received and effectively renders the side brace 31 integral with the tie plate 21.

To provide as much guarding as possible on the flat face of the back of a railroad vehicle wheel, the inner surface of the guard rail head 15 is machined or otherwise shortened so as to increase the guarding surface area of the inner face 16. The guard rail head is machined at the inner surface to afford a flat guard face 16 which faces the traffic rail to thereby increase the area of contact with the wheel compared to a conventional curved guard face.

The center brace 28 and the side braces 31, shown best in FIGS. 2 and 3, are preferably formed integrally from a single blank 41 (FIG. 4) of rigid material conventionally used in railroad track work. The respective parts of the side braces 31 can be seen in the blank 41 relative to the outline of the guard rail 10 superimposed in FIG. 4.

Likewise, slots must be formed in the shim plate 25 which overlies the rectangular openings 39 to allow the entry of the lugs 37. These slots provide further longitudinal support for the shim plate 25 since the side brace 31 can be welded to the upper surface of shim plate 25 along the entire outline of the slots provided for the lugs 37.

Figure 9:
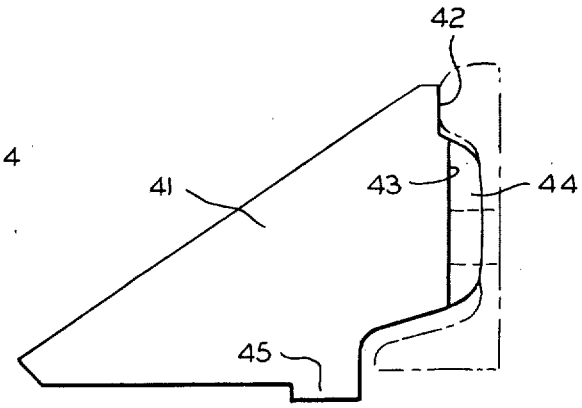
FIG. 9 is a side plan view of the brace shown in FIG. 8 with a position of the guard rail indicated.

FIGS. 5 through 9 show a modified form of the invention, again with the guard rail 10 spaced laterally from and above the traffic rail 11. The guard rail 10, traffic rail 11, tie plate 21, shim plate 25 and locking plate 32 correspond to the like parts shown in FIGS. 1 through 4. It is the means for bracing the outer face of the web and head of the guard rail which are modified in this embodiment. A pair of vertical upright braces 41 engage the outer face of the guard rail 10 and extend laterally outwardly therefrom away from the traffic rail 11. The inner surface of each upright brace 41 has a portion 42 which engages the outer face of the guard rail head 15 (FIG. 9). A lower portion 43 of the inner face of each upright brace is rigidly secured to a cross brace 44 which engages the outer face of the guard rail web. The cross brace 44 is generally D-shaped in cross-section, having an inner generally arcuate face formed to fit and bear against the outer surface of the guard rail web 20. Each upright brace 41 extends outwardly from the cross brace 44, being spaced from the outer base-flange 19 of the guard rail to accommodate its installation. A lug 45 is formed in the bottom surface of each upright brace 41, the lug 45 being adapted to be received into the rectangular openings 39 as discussed above, which are then filled by means of plug welds. The remainder of the bottom surface of the upright braces engages the top surface of the tie plate 21 and is rigidly secured thereto, such as by fillet welds along the nire perimeter of the bottom of each upright brace 41.

To rigidly secure the guard rail 15 into engagement with the brace members 41 and 44, at least one hole is provided through the guard rail web 20 and the cross brace 44, the holes being aligned and adopted to receive a fastening bolt 46. A flat washer 47 and a lock washer 48 may be arranged along the bolt between the head 49 and the guard rail web 20. A nut 50 is tightened onto the outer end between the upright braces to complete the bolt assembly.

In operation, as a railroad vehicle traverses a switch or travels along a curved portion of the track, the wheels of the railroad vehicle may be thrust against the inner face 16 of the guard rail head 15 with extreme lateral force as indicated by the "F" and the associated arrow in FIG. 2. This outward force is counteracted by the engagement of the brace means directly against the opposite face of the guard rail head as well as along a portion of the guard rail web 20. The moment of the force F in the guard rail which tends to rotate the guard rail counterclockwise, is counteracted by the contact of the guard rail base 17 with the upstanding lip or flange 26 of the shim plate 25. The guard rail is bolted rigidly to the brace means and held firmly against the shim plate 25 by the locking plate 32 which bears against the upper surface of the outer base-flange 19. Thus the guard rail 10 is held rigidly in a fixed position relative to the traffic rail 11 but wholly independent thereof. Furthermore, the outer face of the guard rail head 15 is machined to provide as much guarding as possible on the flat face of the back of a railroad vehicle wheel.

It will be understood that modifications and variations may be effected without departing from the scope of the novel concepts of the present invention.

I claim:

1. In combination with a traffic rail, a guard rail spaced laterally therefrom and so supported by a shim plate as to have the head thereof spaced above the head of the traffic rail, brace means located on the side of the guard rail away from the traffic rail, said brace means having an upper surface engaging the outer face of the guard rail head, said brace means having a portion beneath said upper surface engaging the web of the guard rail, a shim plate so supporting the base of the guard rail and having an upwardly extending lip in engagement with an inner face of the guard rail base, a tie plate underlying and supporting the rails, brace means and shim plate, said brace means and shim plate each being welded to the tie plate by weldments located outwardly of the base of the guard rail on the side opposite the traffic rail, and said shim plate also being welded to the tie plate by a weld located at said lip.

2. The combination as described in claim 1 wherein the inner face of the guard rail head is machined to provide a flat guarding surface of increased area.

3. The combination as described in claim 1 wherein the tie plate has a slot for receiving the shim plate and traffic rail base, said slot having a bottom surface and upstanding side walls, the shim plate and traffic rail base substantially filling the slot, and the side walls preventing lateral movement of the shim plate and traffic rail.

4. The combination as described in claim 1, and a fastener extending through the brace means and guard rail web to positively secure the guard rail and brace means together.

5. A guard rail assembly for supporting a guard rail relative to a traffic rail, wherein the head of the guard rail is spaced above the head of the traffic rail, said assembly comprising a shim plate for supporting the base of the guard rail above the base of the traffic rail, a flange on the inner edge of the shim plate facing the traffic rail, said flange extending upwardly generally perpendicular to the shim plate and engaging the inner edge of the guard rail base, a tie plate having a slot for receiving the base of the traffic rail and the shim plate, the slot having a bottom surface and upstanding side walls, means for securing said traffic rail to the tie plate, said shim plate being welded to the tie plate by a first weldment outwardly of the base of the guard rail on the side opposite the traffic rail and by a second weldment located at said flange, brace means engaging the outer face of the head of the guard rail and extending downwardly and outwardly therefrom away from the traffic rail, an inwardly extending portion of the brace means engaging the web of the guard rail, and a weldment outwardly of the first-named weldment securing the brace means to the tie plate to prevent the outward lateral movement of the brace means.

6. The guard rail assembly as described in claim 5, wherein the inner face of the guard rail head is machined to provide a generally flat guarding surface of increased area.

* * * * *